US008689578B2

(12) United States Patent
Lee et al.

(10) Patent No.: US 8,689,578 B2
(45) Date of Patent: Apr. 8, 2014

(54) ICE MAKING APPARATUS AND REFRIGERATOR COMPRISING THE SAME

(75) Inventors: Dong-Hoon Lee, Incheon (KR); Wook-Yong Lee, Bucheon-si (KR); Seung-Hwan Oh, Gunpo-si (KR)

(73) Assignee: LG Electronics Inc., Seoul (KR)

( * ) Notice: Subject to any disclaimer, the term of this patent is extended or adjusted under 35 U.S.C. 154(b) by 966 days.

(21) Appl. No.: 12/375,268

(22) PCT Filed: Aug. 20, 2007

(86) PCT No.: PCT/KR2007/003973

§ 371 (c)(1),
(2), (4) Date: Oct. 20, 2009

(87) PCT Pub. No.: WO2008/023911

PCT Pub. Date: Feb. 28, 2008

(65) Prior Publication Data

US 2010/0037646 A1 Feb. 18, 2010

(30) Foreign Application Priority Data

Aug. 24, 2006 (KR) ..... 10-2006-0080207

(51) Int. Cl.
*F25C 1/04* (2006.01)
*F25C 1/22* (2006.01)

(52) U.S. Cl.
USPC ..... 62/356; 62/340

(58) Field of Classification Search
USPC ..... 62/353, 340; 249/206
See application file for complete search history.

(56) References Cited

U.S. PATENT DOCUMENTS

| | | | | |
|---|---|---|---|---|
| 5,177,980 | A * | 1/1993 | Kawamoto et al. | 62/353 |
| 7,017,364 | B2 * | 3/2006 | Lee et al. | 62/351 |
| 8,181,471 | B2 * | 5/2012 | Heger et al. | 62/137 |

FOREIGN PATENT DOCUMENTS

| | | | |
|---|---|---|---|
| JP | 05-296623 | 11/1993 | |
| JP | 06-011228 | 1/1994 | |
| JP | 06-185841 | 7/1994 | |
| JP | 06-241626 | 9/1994 | |
| KR | 10-2005-0110213 | 11/2005 | |
| WO | WO2006/076976 | * 7/2006 | F25C 1/04 |

OTHER PUBLICATIONS

International Search Report dated Dec. 14, 2007.

* cited by examiner

*Primary Examiner* — Cassey D Bauer
(74) *Attorney, Agent, or Firm* — Ked & Associates, LLP

(57) ABSTRACT

Provided are an ice maker and a refrigerator including the same. The ice maker for making ice is provided on a rear side of a refrigerator door. A tray cover, a water flood prevention rib, and a rotation guide are provided to prevent flooding of water stored in an ice tray forming the ice maker while the refrigerator door is opened/closed. According to the ice maker and the refrigerator, reduction in a storage capacity of the refrigerator is prevented, flooding of water for making ice is prevented, and the ice maker can be more easily used.

27 Claims, 8 Drawing Sheets

ICE MAKING APPARATUS AND REFRIGERATOR COMPRISING THE SAME

TECHNICAL FIELD

The present disclosure relates to a refrigerator, and more particularly, to an ice maker mounted on the rear side of a refrigerator door to make ice, and a refrigerator including the same.

BACKGROUND ART

A refrigerator is a home appliance for maintaining food in a cooling state or a freezing state of low temperature to maintain fresh food for a long time. An ice maker for making ice is provided to a refrigerator brought to the market recently. Generally, a related art ice maker is installed inside a freezing chamber to make ice using cooling air circulating through the freezing chamber.

However, the related art ice maker is installed inside the freezing chamber. Accordingly, the capacity of the freezing chamber where food can be stored substantially reduces by the volume of the ice maker.

DISCLOSURE OF INVENTION

Technical Problem

Embodiments provide an ice maker configured to minimize reduction in a storage capacity of a refrigerator, and the refrigerator including the same.

Embodiments also provide an ice maker configured to minimize a phenomenon that water for making ice floods into an outside during a process of opening/closing a refrigerator door, and the refrigerator including the same.

Embodiments also provide an ice maker configured to allow made ice to be moved more simply, and a refrigerator including the same.

Technical Solution

In one embodiment, an ice maker includes: a frame provided on a rear side of a refrigerator door; an ice tray rotatably installed in the frame; and a tray cover provided to the frame and selectively opening/closing the ice tray depending on rotation of the ice tray.

In another embodiment, an ice maker includes: an ice tray rotatably installed on a rear side of a refrigerator door; a tray cover for selectively opening/closing the ice tray; and a water flood prevention rib extending from an upper edge of the ice tray, and preventing water stored in the ice tray from flooding while the refrigerator door rotates.

In further another embodiment, an ice maker includes: an ice tray rotatably installed on a rear side of a refrigerator door; a tray cover for selectively opening/closing the ice tray depending on rotation of the ice tray; and a rotation guide provided to the ice tray and guiding the rotation of the ice tray.

In still further another embodiment, a refrigerator includes: a main body including a storage space; a door for selectively opening/closing the storage space; and an ice maker according to one of claims 1 to 26.

Advantageous Effects

According to the ice maker of the present disclosure and the refrigerator including the same, reduction in the storage capacity of the refrigerator is minimized, and simultaneously, a phenomenon that water for making ice floods into an outside is prevented, and the ice is simply made.

BEST MODE FOR CARRYING OUT THE INVENTION

An ice maker according to the present disclosure and a refrigerator including the same will now be made.

An ice maker according to an embodiment is described in detail with reference to the accompanying drawings.

Figure 1:
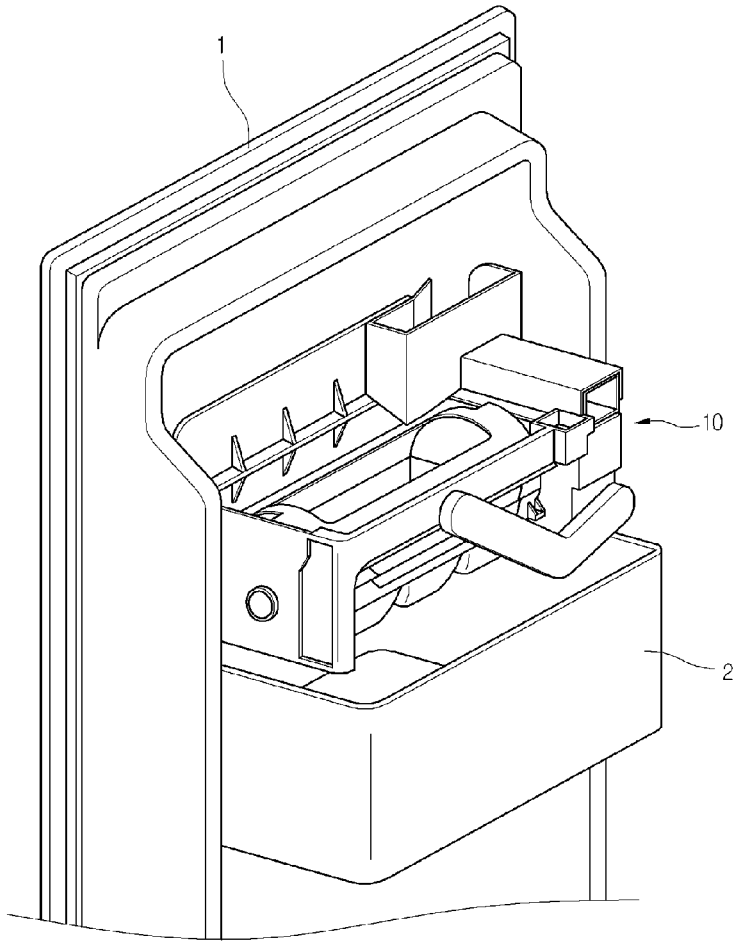
FIG. 1 is a partial perspective view illustrating an ice maker according to an embodiment is mounted on a refrigerator door.
Figure 2:
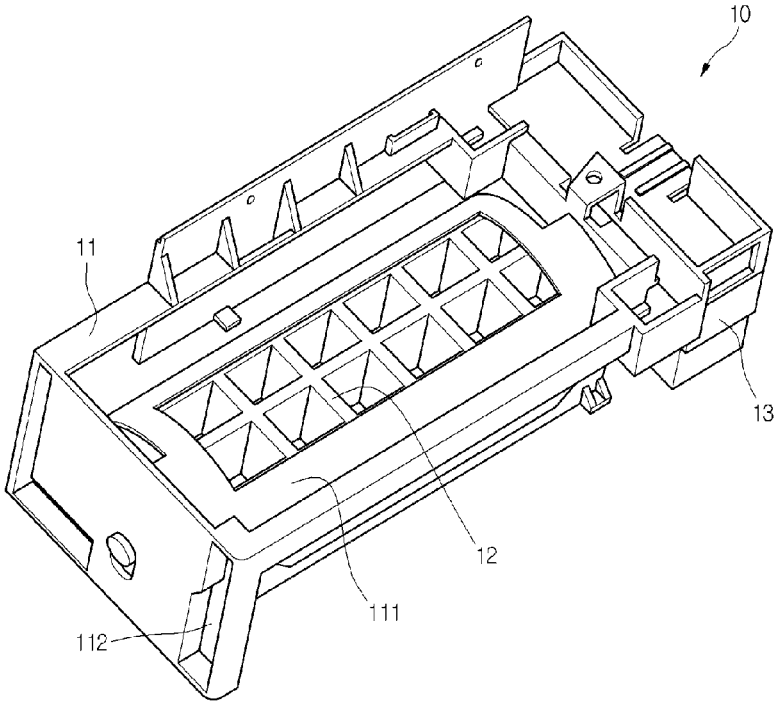
FIG. 2 is a perspective view illustrating an ice maker according to an embodiment.
Figure 3:
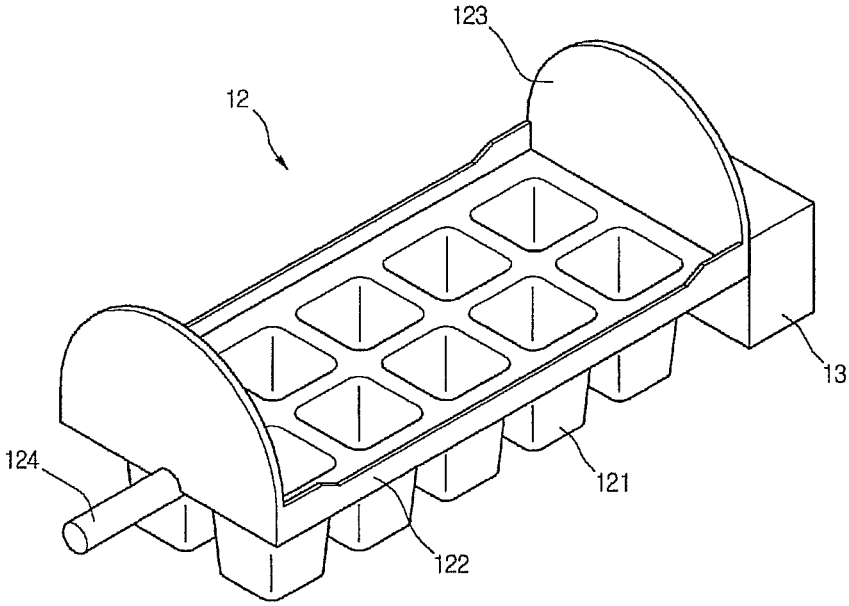
FIG. 3 is a perspective view illustrating an ice tray forming an ice maker according to an embodiment.
Figure 4:
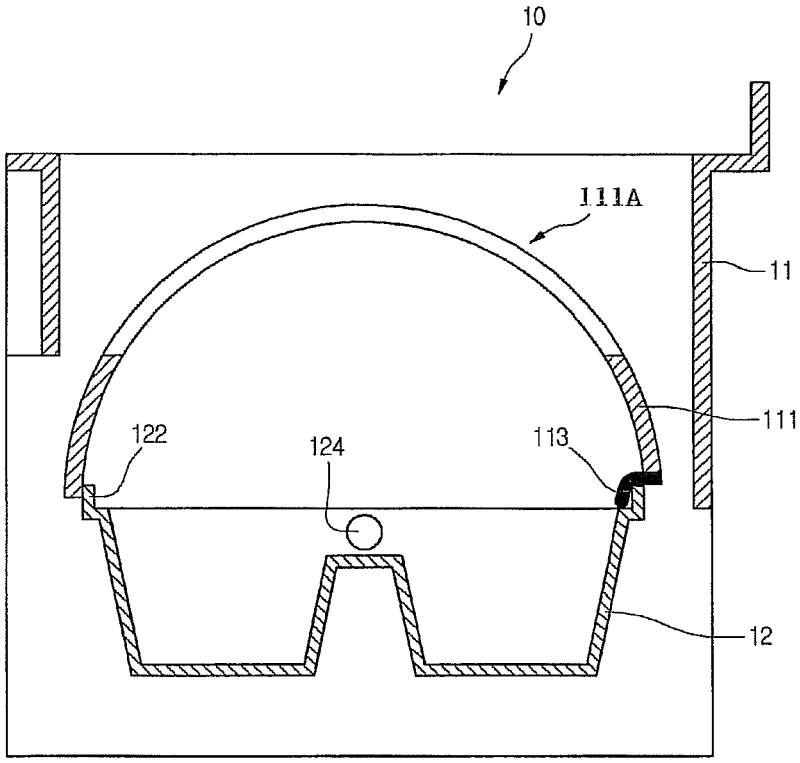
FIG. 4 is a vertical cross-sectional view illustrating a crucial portion of an embodiment.
Figure 5:
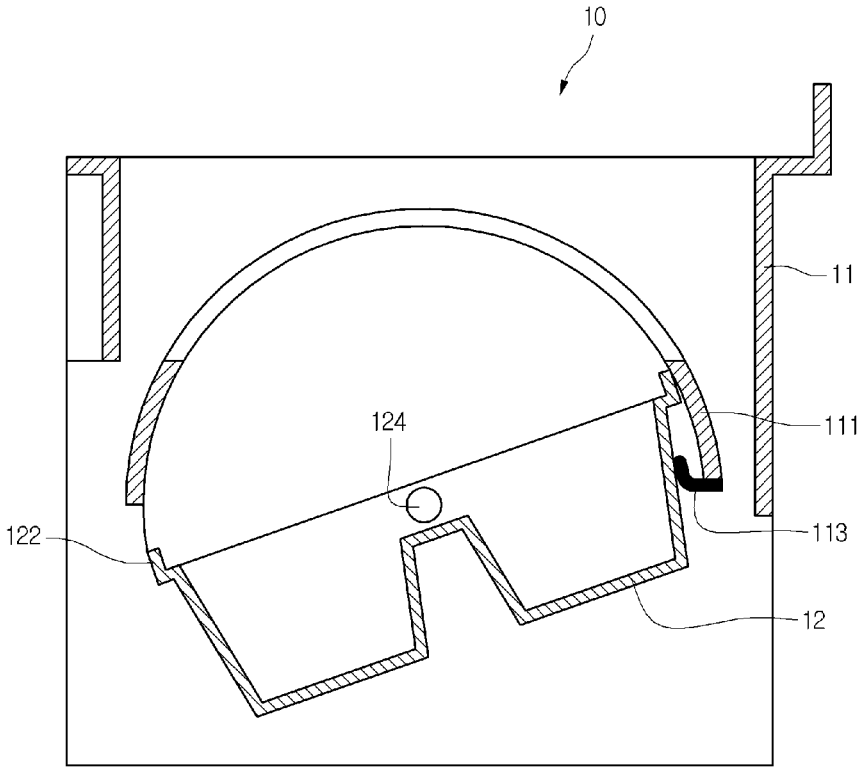
FIG. 5 is a view illustrating a process in which an ice tray rotates according to an embodiment.

FIG. 1 is a partial perspective view illustrating an ice maker according to an embodiment is mounted on a refrigerator door, FIG. 2 is a perspective view illustrating an ice maker according to an embodiment, FIG. 3 is a perspective view illustrating an ice tray forming an ice maker according to an embodiment, FIG. 4 is a vertical cross-sectional view illustrating a crucial portion of an embodiment, and FIG. 5 is a view illustrating a process in which an ice tray rotates according to an embodiment.

Referring to FIG. 1, the ice maker 10 is provided to a portion on the rear side of a refrigerator door 1. Also, an ice bank 2 is detachably installed on the rear side of the door 1 that corresponds to a lower portion blow the ice maker 10. The ice bank 2 stores ice made by the ice maker 10. The ice maker 10 can be provided to a freezing chamber door or a cooling chamber door. The ice maker 10 is preferably provided inside the freezing door.

Next, referring to FIG. 2, the ice maker 10 includes a frame 11 installed on the rear side of the door 1, an ice tray 12 rotatably installed to the frame 11, and a control box 13 in which various parts for rotating the ice tray 12 are mounted.

The frame 11 rotatably supports the ice tray 12. A tray cover 111 for selectively opening/closing the ice tray 12 to prevent water stored in the ice tray 12 from flooding, and a twisting inducing part 112 for inducing twisting of the ice tray 12 are provided to the frame 11.

The tray cover 111 is integrally formed with the frame 11. For example, in the case where the frame 11 is injection-molded, the tray cover 111 can be injection-molded integrally with the frame 11. Of course, the tray cover 111 may be separately manufactured and fixed to the frame 11.

The tray cover 111 selectively opens/closes the ice tray 12 while the ice tray 12 rotates to move the ice. That is, during a process of storing water in the ice tray 12 or a process of making ice using the stored water, the tray cover 111 shields the ice tray 12. When the ice tray 12 rotates to move made ice, the tray cover 111 opens the ice tray 12.

The tray cover 111 is formed in an about semi-cylindrical shape to prevent interference between the tray cover 111 and the ice tray 12 caused by rotation of the ice tray 12. This is because the ice tray 12 is formed in an about flat hexahedral shape, and rotates around a rotational shaft provided in a long side direction to a central portion on a side in a short side direction. Therefore, the shape of the tray cover 111 can change depending on the shape of the ice tray 12 and the location of the rotational shaft.

A water supply opening 111A is formed in the tray cover 111. The water supply opening 111A is a portion through which water to be supplied to the ice tray 12 passes. The water supply opening 111A is formed by cutting a portion of the tray cover 111 in a predetermined shape.

The twisting inducing part 112 protrudes such that a portion of the frame 11 is located on a rotation trace of the ice tray 12. The twisting inducing part 112 contacts one side of the ice tray 12 while the ice tray 12 rotates to separate the ice.

Meanwhile, the ice tray 12 is a portion where ice is substantially made. The ice tray 12 is twisted while it is rotated by a predetermined angle with respect to the frame 11 to separate the made ice. At this point, one side of the ice tray 12 contacts the twisting inducing part 112, so that the ice tray 12 is twisted. The twisting of the ice tray 12 allows the separated ice to fall down into the ice bank 2 and be stored therein.

A motor (not shown) and a plurality of gears (not shown), and a controller (not shown) are provided inside the control box 13. The motor provides driving force for rotating the ice tray 12, and the gears deliver the driving force of the motor to the ice tray 12. The controller controls driving of the motor.

Referring to FIG. 3, a plurality of ice cubes 121 are provided to the ice tray 12. The ice cubes 121 substantially store water supplied through the water supply opening 111A. The water stored in the ice cubes 121 is frozen by cooling air circulating through the freezing chamber, so that ice is made.

Also, water flood prevention ribs 122 are provided to the ice tray 12. The water flood prevention ribs 122 extend upward to a predetermined height from the upper edge of the ice tray 12. The water flood prevention ribs 122 are designed for preventing water stored in the ice cubes 121 from flooding due to centrifugal force generated while the door 1 is opened/closed. The water flood prevention ribs 122 corresponding to the corners of the ice tray 12 may be formed to a height at least greater than a height of the water flood prevention ribs 122 corresponding to the other portions of the ice tray 12. This is because the water stored in the ice cubes 121 leans to the corner portions of the ice tray 12 by centrifugal force generated while the door 1 rotates.

A rotation guide 123 is provided to the upper surface in the short side direction of the ice tray 12. The rotation guide 123 is intended for guiding rotation of the ice tray 12. The rotation guide 123 is formed in an about semicircular disk shape corresponding to the vertical cross-section of the tray cover 111 and extends to the upward direction of the ice tray 12. The rotation guide 123 moves along the inner surface of the tray cover 111 while the ice tray 12 rotates. Also, since the rotation guide 123 extends upward on the upper surface of the tray cover 111, it substantially prevents the water stored in the ice cubes 121 from flooding.

Rotational shafts 124 are provided on side surfaces in the short side direction of the ice tray 121. The rotational shaft 124 serves as a rotational center of the ice tray 121 rotating to separate the ice. The rotational shaft 124 extends from the side surface in the short side direction to the long side direction, and is rotatably connected to the frame 11. Also, the gears for delivering driving force of the motor is connected to one of the rotational shafts 124.

Referring to FIGS. 4 and 5, a sealing member 113 is provided to the lower end of the tray cover 111. The sealing member 113 is intended for preventing water stored in the ice cubes 121 from flooding. In more detail, the sealing member 113 is closely attached on the upper end of the water flood prevention rib 122 provided to the upper one end of the ice tray 12 relatively rising while the ice tray 12 rotates.

For this purpose, the sealing member 113 protrudes toward the ice tray 12 such that at least a portion of the sealing member 113 is located on a rotation trace of the ice tray 12 at the lower end of the tray cover 112. Also, the sealing member 113 is formed of a material having predetermined elasticity, for example, silicon. Therefore, the sealing member 113 is elastically deformed by the ice tray 12 while the ice tray 12 rotates to separate ice. That is, the sealing member 113 is elastically deformed upward or downward by the ice tray 12 while the ice tray 12 rotates.

Also, the lower end of the tray cover 112 corresponding to the opposite side of the sealing member 113, that is, the lower end of the tray cover 112 corresponding to one end of the ice tray 12 that descends while the ice tray 12 rotates to separate the ice, is closely attached on the corresponding outer surface of the water flood prevention rib 122.

Next, a process of making and separating ice in an ice maker according to an embodiment will be described in more detail.

Water supplied through the water supply opening 111A is stored in the ice cubes 121. The water stored in the ice cubes 121 does not flood due to contact between the tray cover 111 and the water flood prevention rib 122, and contact between the water flood prevention rib 122 and the sealing member 113 even when the door 1 rotates. Also, the water stored in the ice cubes 121 is frozen by cooling air circulating through the freezing chamber, so that ice is made.

Meanwhile, when making ice is completed, a controller drives a motor. Driving force of the motor is delivered to the ice tray 12 through gears. Therefore, rotation of the ice tray 12 is guided by the rotation guide 123 moving along the inner surface of the tray cover 111.

The ice tray 12 continues to rotate after it has rotated by a predetermined angle, and is twisted by the twisting inducing part 112. When the ice tray 12 is twisted, made ice is separated from the ice cubes 121 and stored in the ice bank 2. Description of the same construction as that of the previous embodiment is omitted.

MODE FOR THE INVENTION

An ice maker according to another embodiment of the present disclosure will be described in detail with reference to the accompanying drawings.

Figure 6:
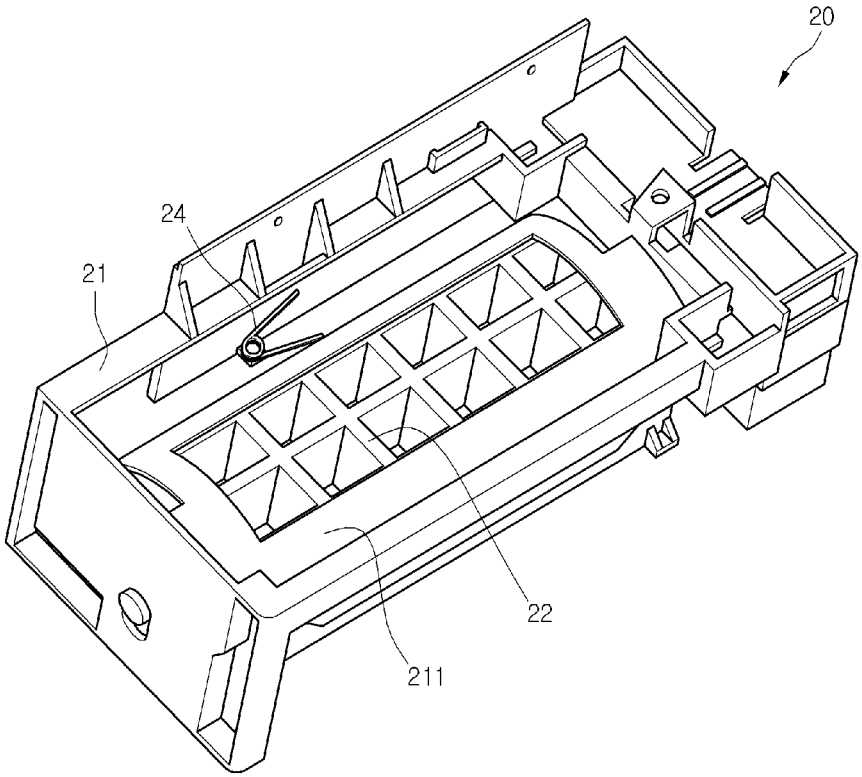
FIG. 6 is a perspective view illustrating an ice maker according to another embodiment.
Figure 7:
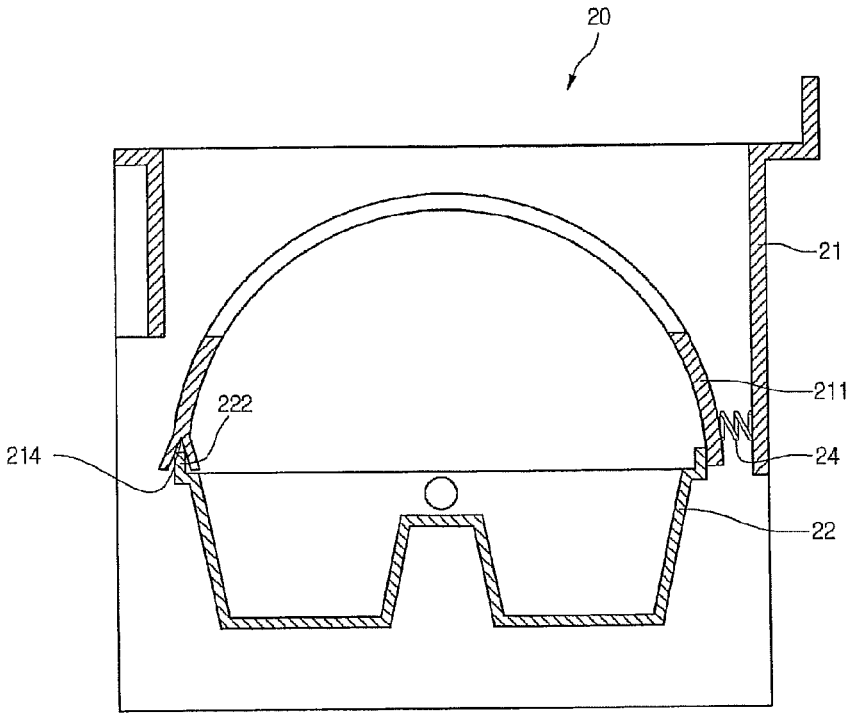
FIG. 7 is a vertical cross-sectional view illustrating a crucial portion of another embodiment.
Figure 8:
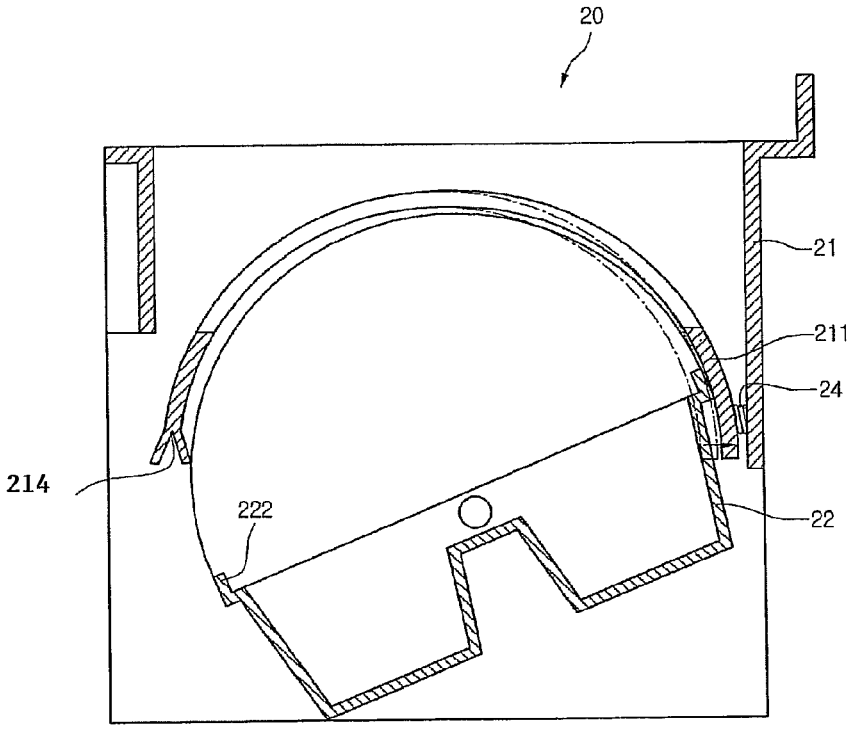
FIG. 8 is a view illustrating a process in which an ice tray rotates according to another embodiment.

FIG. 6 is a perspective view illustrating an ice maker according to another embodiment, FIG. 7 is a vertical cross-sectional view illustrating a crucial portion of another embodiment, and FIG. 8 is a view illustrating a process in which an ice tray rotates according to another embodiment. Descriptions for the same parts as those of the previous embodiment are omitted.

Referring to FIGS. 6 to 8, according to the ice maker 20, a tray cover 211 and a water flood prevention rib 222 contact each other more solidly to prevent water stored in the ice tray 22 from flooding. For this purpose, a water flood prevention groove 214 is provided to the tray cover 211, and an elastic member 24 is provided between the frame 21 and the tray cover 211.

More specifically, the water flood prevention groove 214 is formed in a V shape by recessing a portion of the lower end of the tray cover 211 upward such that the portion is open approximately downward. The water flood prevention rib 222 is selectively inserted into the water flood prevention groove 214 as the ice tray 22 rotates. The water flood prevention groove 214 is provided to the lower end of the tray cover 211 that corresponds to one end of the ice tray 22 relatively descending while the ice tray 22 rotates to separate ice.

The opposite side of the water flood prevention groove 214, that is, the lower end of the tray cover 211 that corresponds to one end of the ice tray 22 relatively rising while the ice tray 22 rotates to separate ice is closely attached on the outer surface of the water flood prevention rib 222. Also, the elastic member 24 is provided between the tray cover 211 closely attached on the outer surface of the water flood prevention rib 222 and the frame 21.

That is, according to an embodiment, the upper end of the water flood prevention rib 222 is inserted into the water flood prevention groove 214 at one end of the tray cover 211. The other end of the tray cover 211 is closely attached on the outer surface of the water flood prevention rib 222 by elastic force of the elastic member 24. Therefore, flooding of water stored in the ice tray 22 can be more efficiently prevented while the refrigerator door is opened/closed.

Meanwhile, examples of the elastic member 24 include various types of springs. That is, for example, the elastic member 24 can be a torsion spring illustrated in FIG. 6, or a coil spring illustrated in FIG. 8.

Next, an ice maker according to still another embodiment is described in detail with reference to the accompanying drawings.

Figure 9:
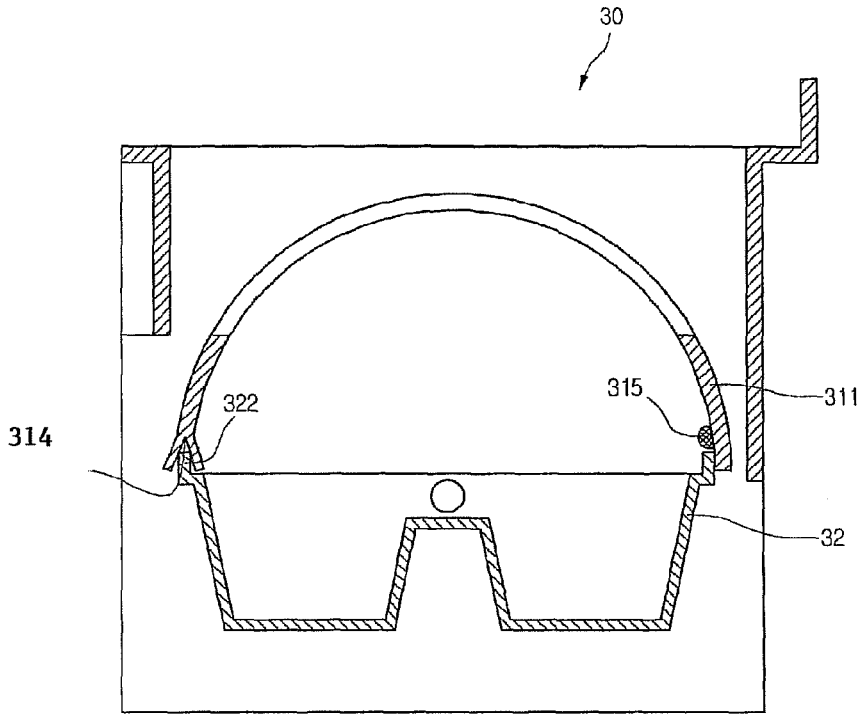
FIG. 9 is a vertical cross-sectional view illustrating a crucial portion of an ice maker according to still another embodiment.
Figure 10:
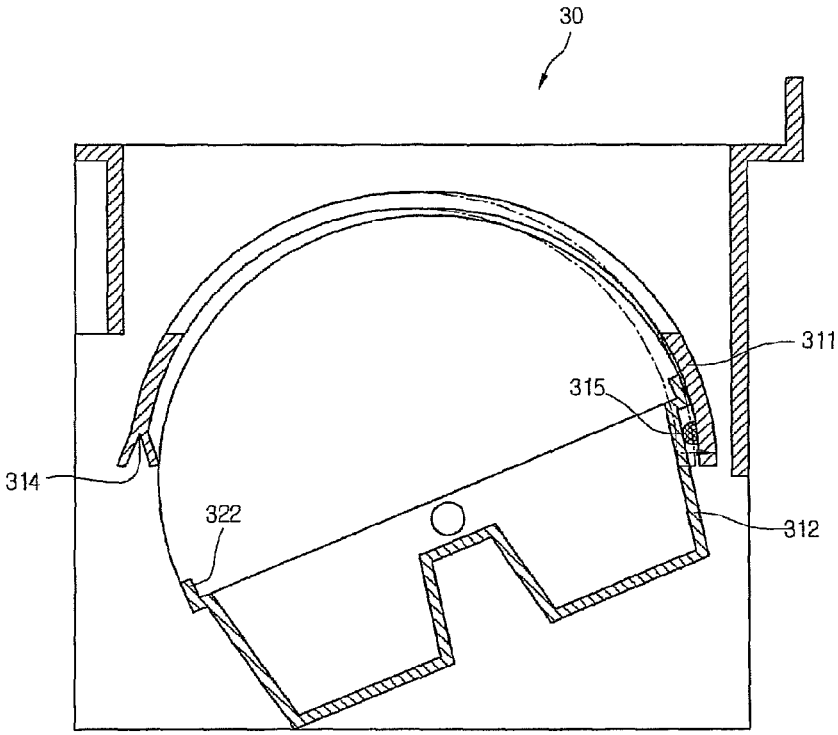
FIG. 10 is a view illustrating a process in which an ice tray rotates according to still another embodiment.

FIG. 9 is a vertical cross-sectional view illustrating a crucial portion of an ice maker according to still another embodiment, and FIG. 10 is a view illustrating a process in which an ice tray rotates according to still another embodiment. Descriptions for the same parts as those of the previous embodiment are omitted.

Referring to FIGS. 9 and 10, according to the ice maker 30, flooding of water stored in the ice tray 32 is more efficiently prevented by a blocking rib 315 provided on the inner surface of the tray cover 311. The blocking rib 315 can be substantially formed integrally with the tray cover 311. Also, the blocking rib 315 selectively contacts the upper surface of the ice tray 32, that is, the upper surface of the water flood prevention rib 322 as the ice tray 32 rotates.

In the embodiment, the blocking rib 315 protrudes from the inner surface of the tray cover 311 that corresponds to one end of the ice tray 32 relatively rising while the ice tray 32 rotates to separate ice. At least a portion of the blocking rib 315 is located on a rotation trace of the ice tray 32. Therefore, the ice tray 32 slides over the blocking rib 315 while the ice tray 32 rotates to separate the ice. At this point, the tray cover 311 may be elastically deformed by the projected length of the blocking rib 315. A water flood prevention groove 314 corresponding to the water flood prevention groove 214 of the previous embodiment can be formed at one end of the tray cover 311 that corresponds to the opposite side of the blocking rib 315, that is, one end of the tray cover 311 that corresponds to one end of the ice tray 32 relatively falling while the ice tray 32 rotates to separate the ice.

Next, an ice maker according to yet another embodiment is descried in detail with reference to the accompanying drawings.

Figure 11:
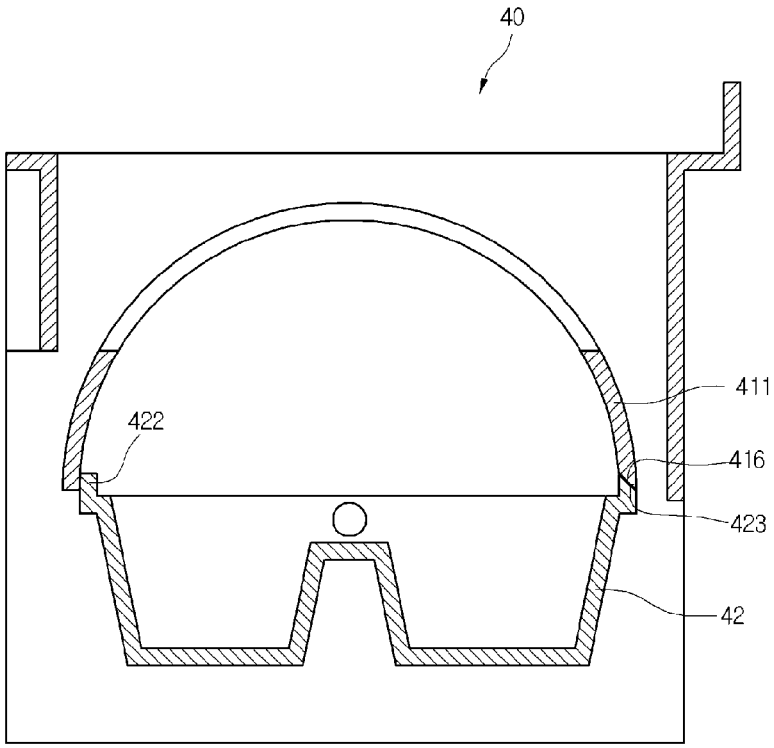
FIG. 11 is a vertical cross-sectional view illustrating a crucial portion of an ice maker according to still another embodiment.
Figure 12:
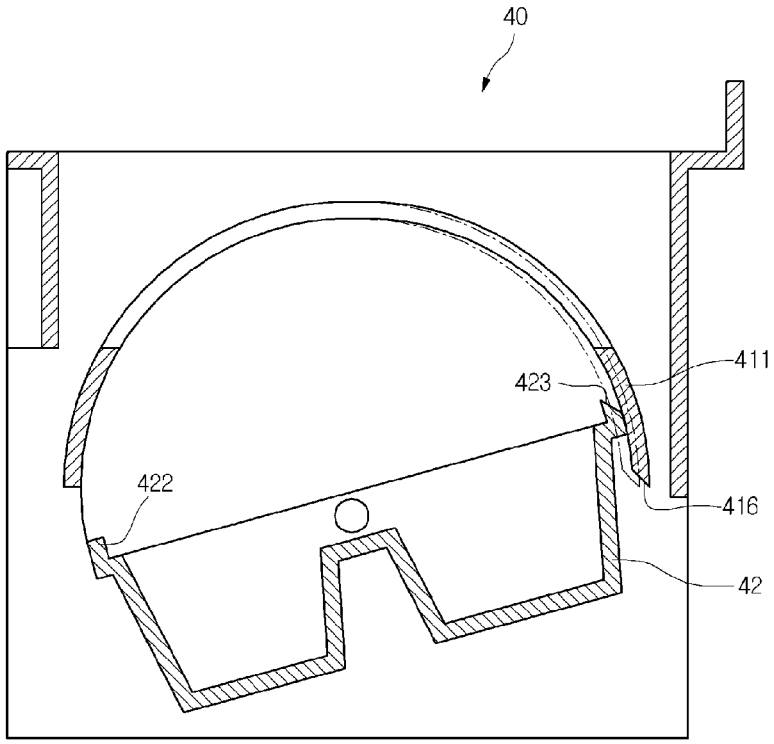
FIG. 12 is a view illustrating a process in which an ice tray rotates according to still another embodiment.

FIG. 11 is a vertical cross-sectional view illustrating a crucial portion of an ice maker according to still another embodiment, and FIG. 12 is a view illustrating a process in which an ice tray rotates according to yet another embodiment. Descriptions for the same parts as those of the previous embodiment are omitted.

Referring to FIGS. 11 and 12, according to the ice maker 40, a contact area of the lower end of a tray cover 411 and the upper end of a water flood prevention rib 422 is increased, so that flooding of water stored in an ice tray 42 is more efficiently prevented. For this purpose, an inclined plane 416 formed at a predetermined angle is provided at the lower end of the tray cover 411. Also, an inclined plane 423 formed in an angle matching with the inclined plane 416 of the tray cover 411 is provided at the upper end of the water flood prevention rib 422 that corresponds to the inclined plane 416 of the tray cover 411.

In the embodiment, the inclined planes 416 and 423 are provided, respectively, at the lower end of the tray cover 411 and the upper end of the water flood prevention rib 422 that correspond to one end of the ice tray 42 relatively rising while the ice tray 42 rotates to separate the ice. At this point, the inclined plane 423 of the water flood prevention rib 422 may slide along the inclined plane 416 of the tray cover 411 to prevent one end of the ice tray 42 from interfering with the inclined plane 416 of the tray cover 411 and the inclined plane 423 of the water flood prevention rib 422. For this purpose, the inclined plane 416 of the tray cover 411 may be inclined downward toward the outer side of the tray cover 411, and the inclined plane 423 of the water flood prevention rib 422 may be inclined upward toward the inner side of the water flood prevention rib 422 so that it matches with the inclined plane 416 of the tray cover 411. The lower end of the tray cover 411 that corresponds to the opposite side of the inclined planes 416 and 423, that is, the lower end of the tray cover 411 that corresponds to one end of the ice tray 42 relatively falling while the ice tray 42 rotates to separate the ice, is closely attached on the corresponding outer surface of the water flood prevention rib 422.

Although the inclined planes 416 and 423 are provided, respectively, only at the lower end of the tray cover 411 and the upper end of the water flood prevention rib 422 that correspond to one end of the ice tray 42 relatively rising while the ice tray 42 rotates to separate the ice in the embodiment, an inclined plane can be provided also at the lower end of the tray cover 411 and the upper end of the water flood prevention rib 423 that correspond to the opposite side of the one end of the ice tray 42. Also, the water flood prevention grooves 214 and 314 of the previous embodiments may be formed at the lower end of the tray cover 411 that corresponds to the opposite side of the inclined plane 416.

Next, an ice maker according to still another embodiment is described in detail with reference to the accompanying drawings.

Figure 13:
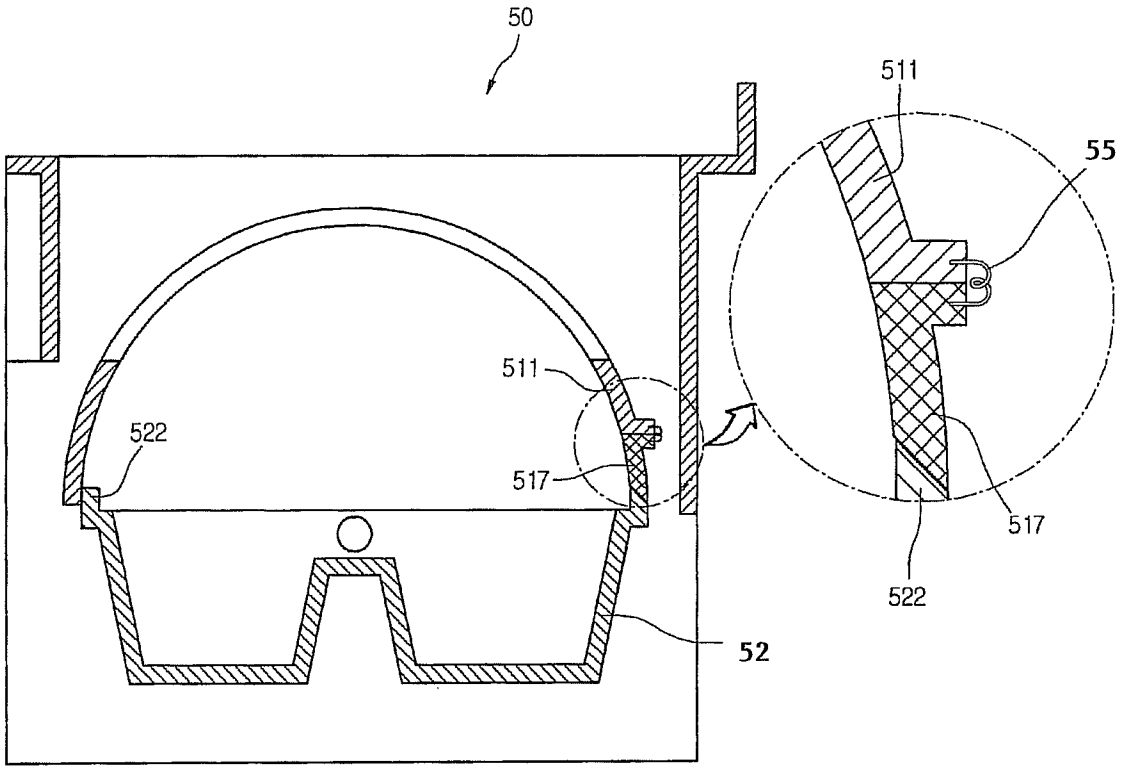
FIG. 13 is a vertical cross-sectional view illustrating a crucial portion of an ice maker according to still another embodiment.
Figure 14:
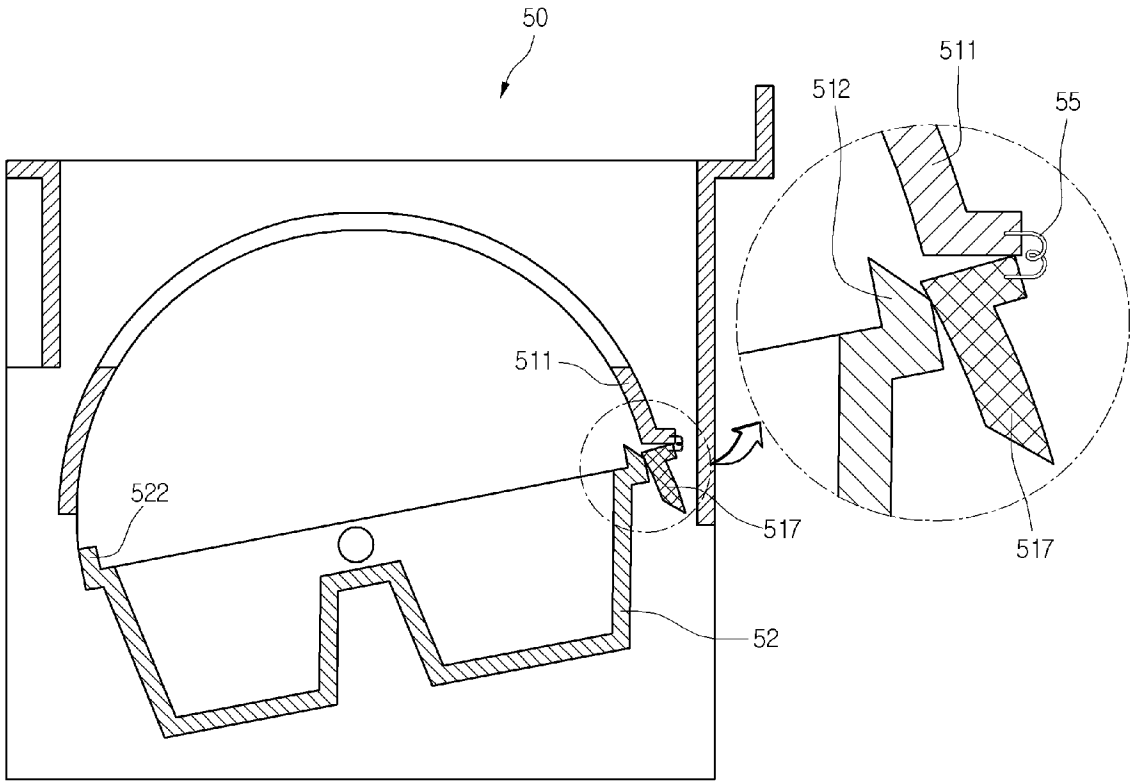
FIG. 14 is a view illustrating a process in which an ice tray rotates according to still another embodiment.

FIG. 13 is a vertical cross-sectional view illustrating a crucial portion of an ice maker according to still another embodiment, and FIG. 14 is a view illustrating a process in which an ice tray rotates according to still another embodiment.

Referring to FIGS. 13 and 14, according to the ice maker 50, flooding of water stored in the ice tray 52 is more efficiently prevented by a rotation cooperating portion 517 rotating with respect to the tray cover 511 in cooperation with rotation of the ice tray 52. The rotation cooperating portion 517 is rotatably connected to the lower end of a tray cover 511 that corresponds to one end of an ice tray 52 relatively rising while the ice tray 52 rotates to separate ice.

The lower end of the rotation cooperating portion 517 is closely attached on the upper end of a water flood prevention rib 522. At this point, the lower end of the rotation cooperating portion 517 and the upper end of the water flood prevention rib 522 may have the same inclined planes as the inclined planes 416 and 423 provided to the tray cover 411 and the water flood prevention rib 422 of the previous embodiment.

An elastic member 55 is provided to give the rotation cooperating portion 517 elastic force in a direction contacting the water flood prevention rib 522. The elastic member 55 substantially connects the tray cover 511 and the rotation cooperating portion 517.

Therefore, in the embodiment, the rotation cooperating portion 517 is closely attached on the water flood prevention rib 522 by elastic force of the elastic member 55. With this state, when the ice tray 52 rotates to separate ice, the rotation cooperating portion 517 rotates by the rotation of the ice tray 52, so that the rotation cooperating portion 517 is separated from the water flood prevention portion 522.

Meanwhile, in the embodiment, the lower end of the tray cover 511 that corresponds to the opposite side of the rotation cooperating portion 517 can be closely attached on the outer surface of the water flood prevention rib 522 as in the previous embodiments. Of course, as in the previous embodiments, a water flood prevention groove for receiving the upper end of the water flood prevention rib 522 can be formed in the lower end of the tray cover 511 also in the embodiment.

It should be understood that numerous other modifications and embodiments can be devised by those skilled in the art that will fall within the spirit and scope of the principles of this disclosure. Also, the scope of the present disclosure should be construed on the basis of the appended claims.

INDUSTRIAL APPLICABILITY

An ice maker and a refrigerator including the same according to the present disclosure provides the following effects.

According to an embodiment, an ice maker is mounted in a refrigerator door. Accordingly, the ice maker prevents reduction in the storage capacity of a storage space of a refrigerator, so that a larger amount of food can be stored in the refrigerator.

According to an embodiment, elements such as a tray cover and a water flood prevention rib are provided to prevent water stored in an ice tray from flooding. Accordingly, flooding of the water stored in the ice tray is prevented while a refrigerator door is opened/closed.

Also, according to an embodiment, rotation of an ice tray is guided by a rotation guide. Therefore, the operation of an ice maker is more efficiently performed, so that user utility increases.

The invention claimed is:

1. An ice maker, comprising:

a frame provided on a rear side of a refrigerator door;

an ice tray rotatably installed in the frame;

a tray cover provided to the frame and selectively opening/closing the ice tray as the ice tray rotates; and a rotation guide that extends in an upward direction from an upper surface of the ice tray and guides the rotation of the ice tray, wherein the rotation guide is integrally formed with the ice tray and extends upward from the upper surface of the ice tray in a solid semicircular plate shape corresponding to a vertical cross-section of the tray cover such that the rotation guide rotates together with the ice tray.

2. The ice maker according to claim 1, wherein at least a portion of the tray cover closely contacts the upper surface of the ice tray.

3. The ice maker according to claim 1, wherein a shape of the tray corresponds to a rotation trace of the ice tray to prevent interference with the ice tray as it rotates.

4. The ice maker according to claim 1, wherein the tray cover is separately manufactured and fixed to the frame, or integrally formed with the frame.

5. The ice maker according to claim 1, wherein the tray cover is elastically deformed by rotation of the ice tray while shielding the ice tray.

6. The ice maker according to claim 1, further comprising a blocking rib provided on the tray cover, protruding from an inner surface of the tray cover and closely contacting an upper portion of the ice tray.

7. The ice maker according to claim 6, wherein the blocking rib is formed on a portion of the tray cover that corresponds to a first side of the ice tray that rises relative to a second side of the ice tray opposite the first side thereof as the ice tray rotates.

8. The ice maker according to claim 6, wherein the ice tray slides over the blocking rib while it rotates.

9. The ice maker according to claim 1, further comprising a water supply opening provided in the tray cover through which water to be stored in the ice tray is supplied with the ice tray is shielded by the tray cover.

10. The ice maker according to claim 9, wherein the water supply opening is formed by cutting a portion of the tray cover.

11. The ice maker according to claim 1, further comprising a sealing member provided on one side of the tray cover to selectively contact the upper surface of the ice tray as the ice tray rotates, and elastically deformed by rotation of the ice tray.

12. The ice maker according to claim 1, further comprising:

a rotation cooperating portion rotatably connected to the tray cover and selectively contacting the upper surface of the ice tray; and an elastic member coupled to the rotation cooperating portion and the tray cover, wherein the elastic member imparts an elastic force on the rotation cooperating portion such that the rotation cooperating portion rotates back to a position contacting the upper surface of the ice tray.

13. The ice maker according to claim 12, wherein the rotation cooperating portion rotates in a direction that separates the rotation cooperating portion from the upper surface of the ice tray when the ice tray rotates, and rotates in response to the elastic force of the elastic member to contact the upper surface of the ice tray when the ice tray is restored to an initial position.

14. The ice maker according to claim 12, wherein the upper surface of the ice tray and a lower end of the rotation cooperating portion have inclined portions respectively, the respective inclined portions forming matching mating surfaces.

15. The ice maker according to claim 1, wherein the tray cover further comprises an elastic member that provides an elastic force allowing the tray cover to be closely attached on the ice tray.

16. The ice maker according to claim 15, wherein at least a portion of the tray cover is closely attached on an outer surface of the ice tray, and the elastic force generated by the elastic member is applied to the tray cover such that a corresponding portion of the tray cover is closely attached on the outer surface of the ice tray.

17. An ice maker comprising:

an ice tray rotatably installed on a rear side of a refrigerator door;

a tray cover for selectively opening/closing the ice tray;

a water flood prevention rib extending from an upper edge of the ice tray, and preventing water stored in the ice tray from overflowing; and a rotation guide that extends in an upward direction from an upper surface of the ice tray and guides the rotation of the ice tray, wherein the rotation guide is integrally formed with the ice tray and extends upward from the upper surface of the ice tray in a solid semicircular plate shape corresponding to a vertical cross-section of the tray cover such that the rotation guide rotates together with the ice tray.

18. The ice maker according to claim 17, wherein a height of a portion of the water flood prevention rib that corresponds to an edge portion of the ice tray is greater than or equal to a height of a remaining portion of the water flood prevention rib that corresponds to a remainder of the ice tray.

19. The ice maker according to claim 17, wherein one of a lower end of the tray cover or a corresponding upper end of the water flood prevention rib is selectively inserted into the other as the ice tray rotates.

20. The ice maker according to claim 19, wherein the upper end of the water flood prevention rib corresponding to a first side of the ice tray descends relative to a second side of the ice tray while the ice tray rotates and the upper end of the water flood prevention rib is separated from a water flood prevention groove formed in the lower end of the tray cover.

21. The ice maker according to claim 17, wherein the lower end of the tray cover and the corresponding upper end of the water flood prevention rib are formed to match with each other, and selectively contact each other as the ice tray rotates.

22. The ice maker according to claim 21, further comprising a first inclined portion formed on the upper end of the water flood prevention rib and a second inclined portion formed on the lower end of the tray cover, wherein the first and second inclined portions are formed at a corresponding angle and are closely attached, and are separated as the ice tray rotates such that a first side of the ice tray descends relative to a second side of the ice tray opposite the first side thereof as the ice tray rotates to provide for ice separation.

23. An ice maker, comprising:

an ice tray rotatably installed on a rear side of a refrigerator door;

a tray cover for selectively opening/closing the ice tray as the ice tray rotates; and a rotation guide that extends in an upward direction from an upper surface of the ice tray and guides the rotation of the ice tray, wherein the rotation guide is integrally formed with the ice tray and extends upward from the upper surface of the ice tray in a solid semicircular plate shape corresponding to a vertical cross-section of the tray cover such that the rotation guide rotates together with the ice tray.

24. The ice maker according to claim 23, wherein the tray cover is formed to correspond to a rotation trace of the ice tray, and the rotation guide moves along an inner surface of the tray cover when the ice tray rotates.

25. The ice maker according to claim 23, wherein the tray cover is formed in a semi-cylindrical shape corresponding to a rotation trace of the ice tray, and the rotation guide is formed in a shape corresponding to a vertical cross-section of the tray cover.

26. The ice maker according to claim 23, wherein the rotation guide is provided on the upper surface of the ice tray such that the rotation guide is perpendicular to a rotation shaft of the ice tray to move along an inner surface of the tray cover when the ice tray rotates.

27. A refrigerator comprising the ice maker according to claim 1.

* * * * *